United States Patent [19]

Cutting

[11] 3,932,787

[45] Jan. 13, 1976

[54] TUNABLE COAXIAL MAGNETRONS

[75] Inventor: Alan Butler Cutting, Maidenhead, England

[73] Assignee: E M I - Varian Limited, Hayes, England

[22] Filed: Nov. 6, 1974

[21] Appl. No.: 521,535

[30] Foreign Application Priority Data

Nov. 7, 1973 United Kingdom ..... 51646/73

[52] U.S. Cl. ..... 315/39.61; 315/39.51; 315/39.77

[51] Int. Cl.[2] ..... H01J 25/50

[58] Field of Search..... 315/39.61, 39.75, 39.77, 315/39.51

[56] References Cited

UNITED STATES PATENTS

| | | | |
|---|---|---|---|
| 3,064,158 | 11/1962 | Buck | 315/39.75 X |
| 3,365,609 | 1/1968 | Barbasso, Jr. | 315/39.61 X |
| 3,412,285 | 11/1968 | Gerard | 315/39.75 X |
| 3,435,284 | 3/1969 | Downing et al. | 315/39.61 |
| 3,441,796 | 4/1969 | Cooper | 315/39.61 |
| 3,731,137 | 5/1973 | Foreman | 315/39.77 |

*Primary Examiner*—Saxfield Chatmon, Jr.
*Attorney, Agent, or Firm*—Fleit & Jacobson

[57] ABSTRACT

This relates to coaxial magnetrons and to a tuning arrangement for the stabilizing cavity including a fixed tuning element and a movable tuning element which is continuously and unidirectionally displaceable for repetitive cooperation with the fixed element. The arrangement is particularly suitable for "ditherable" or frequency-agile megnetrons.

6 Claims, 3 Drawing Figures

TUNABLE COAXIAL MAGNETRONS

This invention relates to coaxial magnetrons. "Spin-tuning" of magnetrons is effected by rotating a member in the vicinity of the anode cavities, but this arrangement raises practical problems. For "frequency-agile" coaxial magnetrons a reciprocally movable tuning member has been proposed. This proposal has the disadvantage of needing an eccentric cam with a large variation of thrust to produce the large accelerations of the tuning member for rapid tuning. Another proposal for coaxial magnetrons is "gyro-tuning" using a number of elements rotating about separate axes but the geared drive is complex. A further proposal, in U.S. Pat. No. 3412285, is to place within the stabilizing cavity a set of fixed vanes projecting from an end wall and a set of movable vanes extending through an end wall to adjacent the fixed vanes, the movable vanes being rotatable in the cavity to vary the frequency of the magnetron.

According to the present invention there is provided a coaxial magnetron including a resonator cavity and a coupled stabilizing cavity, and a stabilizing cavity tuning means including a fixed dielectric portion to support a fixed conductive tuning element at the middle of the cavity and a movable dielectric portion to support a movable tuning element for rotation through the middle of the cavity to overlap or not overlap the fixed element, neither conductive tuning element extending to the wall of the cavity, the movable tuning element being capable of continuous unidirectional rotational displacement to vary said overlap and thereby vary the frequency of the magnetron.

According to the invention there is provided a coaxial magnetron including a resonator cavity and a coupled stabilizing cavity and a stabilizing tuning means, including a fixed window tuning element formed in a wall of the cavity and a movable tuning element adjacent said wall to variably restrict said window, said movable tuning element not extending to the middle of the cavity and capable of continuous unidirectional rotational displacement for repetitive cooperation with the fixed element vary the frequency of the magnetron.

Figure 1:
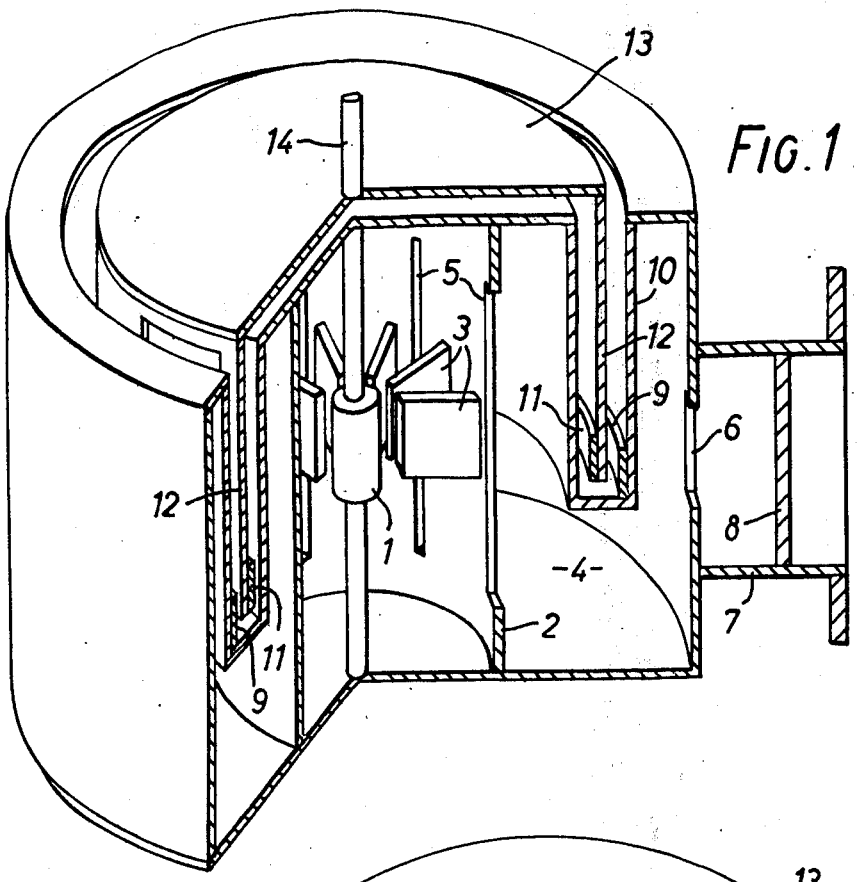
Figure 2:
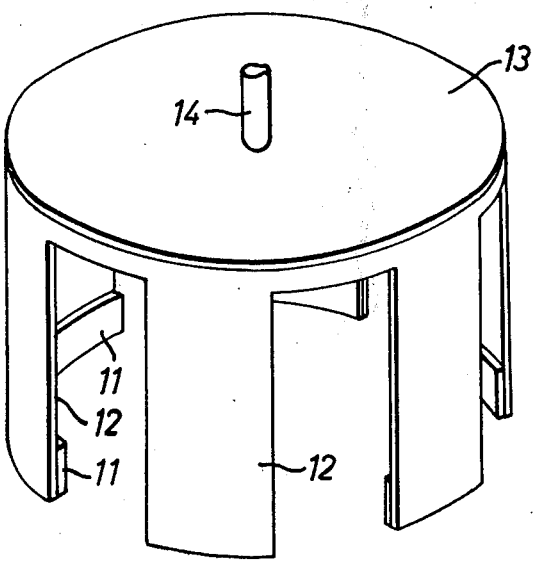
Figure 3:
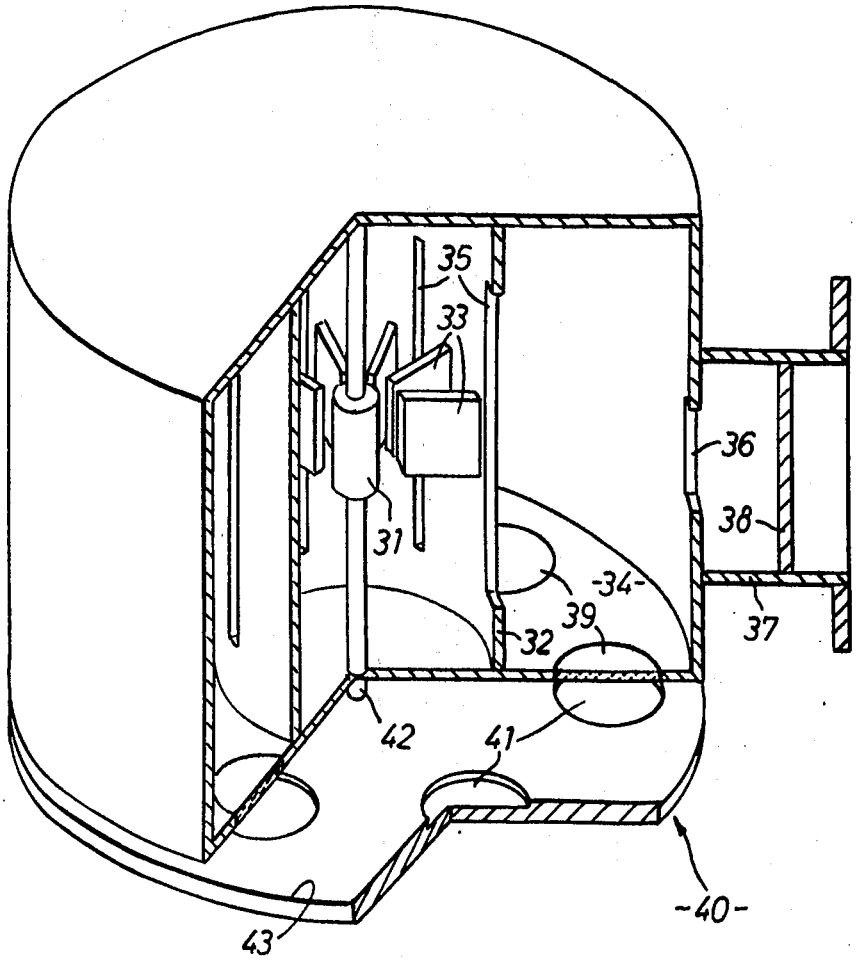

In order that the invention may be clearly understood and readily carried into effect it will now be described by way of example with reference to the accompanying drawings in which:

FIG. 1 is a diagrammatic, partly cut-away, perspective view of a coaxial magnetron embodying the invention, FIG. 2 shows a rotatable tuning member of FIG. 1, and FIG. 3 is a diagrammatic, partly cut-away, perspective view of another embodiment of the invention.

Referring to FIGS. 1 and 2 this shows a coaxial magnetron comprised of the usual known elements, namely a cathode 1 surrounded by a cylindrical anode 2 having vanes such as 3 and a surrounding coaxial stabilizing cavity 4. Coupling slots such as 5 are provided in the anode 2 between alternate pairs of vanes. Microwave energy is coupled out of the stabilizing cavity 4 through a slot 6 and an output waveguide 7 having a dielectric window 8.

Additionally a tuning means for the magnetron is disposed in the stabilizing cavity 4 and at least one element of the tuning means is rotatable about the axis of the magnetron. The tuning means shown comprises a plurality of fixed arcuate electrically conductive elements such as 9 spaced along the circumference of a circle coaxial with the cavity 4. In the present example, the conductive elements 9 extend over an arc length of 30° and are spaced apart by 30°. The fixed tuning elements 9 are secured to an annular channel member 10 which forms a re-entrant space in the cavity 4. The channel member 10 is formed of a dielectric material, e.g. glass or ceramics which is sealed to the magnetron casing to maintain the vacuum in the magnetron. The tuning means shown also comprises a plurality of arcuate electrically conductive elements such as 11 which are rotatable about the axis of the magnetron. In this example, the conductive elements 11 also extend over an arc length of 30° and are spaced apart by 30°. They are carried by fingers or blades such as 12, also of a material which is substantially transparent to microwave energy, and which are disposed about a cylindrical surface in the annular channel member 10. The blades 12 depend from a disc 13 having a rod 14 secured thereto which forms an axis of rotation coaxial with the axis of the magnetron. The rod 14 is rotatably mounted in a suitable bearing (not shown) and may carry indexing means to determine the angular position of the tuning elements 11 and/or may be motor driven.

In operation, the stabilizing cavity 4 is excited in the $TE_{011}$ mode in which the E-field is circular and has no circumferential variation of phase, but, both radially and axially, the E-field is a maximum in the middle of the stabilizing cavity 4. The H-field is a minimum in this region. The tuning elements 9 and 11 are positioned close to the maximum E-field and produce pertubations in the E-field which reduce the resonant frequency of the cavity 4, the amount of the reduction depending upon the effective arc length of the perturbing elements. The effective arc length of the fixed tuning elements 9 is varied by rotation of the movable tuning elements 11 so as to vary the overlap of the elements 9 and 11.

By shaping the tuning elements the perturbation of frequency can be arranged to be required function of the angle of rotation of the shaft 14.

In the $TE_{011}$ mode, there are no electric current lines radially across the end walls of the cavity and so the annular gap formed by the mouth of channel member 10 does not upset the operation of the magnetron. However, in cases where the perturbations produced by the tuning elements 9 and 11 give rise to radial currents, the slot may be choked by any suitable means.

For high power magnetrons, the power density stored in the stabilizing cavity 4 is large and voltage breakdown may tend to occur. In order to avoid this, a suitable medium such as a fluorocarbon low loss liquid may be provided in the channel member 10.

Various modifications will be apparent to anyone skilled in the art. For example, the perturbing elements, namely the tuning elements 9 and 11, may be formed of a high dielectric content material instead of electrically conductive material. Also, the fixed perturbing elements may be supported on the vacuum side of the channel member 10. Furthermore, the number of fixed and rotatable tuning elements may be other than six. If desired, the magnetron may also be provided with a conventional, axially adjustable, annular piston tuner.

FIG. 3 shows another embodiment of the invention in which the usual parts 1 – 8 similar to those of FIG. 1 are prefixed by "3" in the references. The tuning means in the embodiment of FIG. 3 includes a conductive disc 40 which has several recesses such as 41 in one face 43 and forms the movable element. The wall of the stabilizing cavity 34 has several "windows" 39 forming the fixed element. These windows are vacuum tight but of suitable material to permit the adjacent face of disc 40 to form part of the wall and thus determine the volume and resonant frequency of the cavity. A suitable material for the windows is a dielectric material such as glass or ceramic which can be made part of the wall in any known manner. The windows and recesses are arranged in the same chosen relationship. In the illustrated embodiment there are six windows 39 and recesses 41 equally spaced on the same pitch circle diameter and of such size that each recess can coincide with a window or not overlap any window, depending on the relative angular position of the disc.

Disc 40 is supported for rotation about an axis through 42, by means not shown. The rotation must be arranged so that the disc is stable in its separation from the cavity 34.

In operation when a recess 41 coincides with a window 39 the volume of cavity 34 is increased by a small amount, the cavity now effectively extending to the bottom of the recess 41. The resonant frequency of cavity 34 is thus slightly reduced and thereby the frequency of the magnetron itself reduced. The magnetron is operated in the $TE_{011}$ mode as before with the H-field maximum and E-field minimum adjacent the wall of the cavity. The H-field is thus perturbed by the presence of the recess, the amount depending on the size of the recess. When by rotation of disc 40 face 43 is outside a window the volume of cavity 34 is at the minimum value and the magnetron frequency at the highest value for the illustrated embodiment. Clearly the number, size and shape of the recesses and windows and the spacing of disc 40 from the cavity wall will affect the highest frequency and the reduction of this frequency on rotation of disc 40.

By rotation of the disc at a suitable speed, the operating frequency of the magnetron can be "dithered" in a regular manner. For example a magnetron operating at a frequency in the order of 10,000 MHz can be dithered by some 400 MHz at 1000 cycles per second.

In the illustrated embodiment the tuning element is outside the magnetron vacuum chamber. However the movable tuning element may be in the vacuum chamber although the drive may then be more complicated.

An important advantage of the embodiments described above is that the tuning element may be rotated continuously at constant speed. This unidirectional movement is an advantage over reciprocal movement of the tuning element in which reversal of the direction of movement causes wear and irregularity of operation.

The invention thus provides a frequency-agile coaxial magnetron which is of relatively simple construction and in which it is not essential to have a bearing for the rotatable tuning element within the vacuum system.

The tuning of the single stabilizing cavity as opposed to the many cavities of the resonator portion avoids variations in the tuning caused by inevitable minor differences in the resonator geometry.

The invention is also applicable to the so-called inverse magnetron in which the resonant cavity surrounds the stabilizing cavity.

What I claim is:

1. A coaxial magnetron including a resonator cavity and a wall means forming a coupled stabilizing cavity, and a stabilizing cavity tuning means including a fixed dielectric portion supporting a fixed conductive tuning element at the middle of the cavity and a movable dielectric portion supporting a movable conductive tuning element for rotation through the middle of the cavity to either overlap or not overlap the fixed element, neither the fixed tuning element or the movable tuning element extending to the wall of the stabilizing cavity, the movable tuning element being capable of continuous unidirectional rotational displacement to vary said overlap and thereby vary the frequency of the magnetron.

2. A magnetron as claim in claim 1 in which the fixed tuning element is spaced sections of a conductive ring supported in the stabilizing cavity while the movable tuning element is similar spaced sections of a ring supported for displacement to be alternately adjacent a corresponding fixed section or not adjacent a fixed section.

3. A magnetron as claimed in claim 2 and in which the stabilizing cavity includes a re-entrant channel of dielectric material extending to the region of the maximum of the electric field and supporting said fixed tuning element, and a cup-shaped dielectric member supporting said movable tuning element for rotation with respect to the fixed element.

4. A coaxial magnetron including a resonator cavity and a coupled stabilizing cavity and a stabilizing cavity tuning means, including a fixed window tuning element formed in a wall of the stabilizing cavity and a movable tuning element adjacent said wall to variably restrict said window, said movable tuning element not extending to the middle of the stabilizing cavity and being capable of continuous unidirectional displacement for repetitive cooperation with the fixed window to vary the frequency of the magnetron.

5. A magnetron as claimed in claim 4 in which the fixed tuning element is formed by a conductive circular end wall of the stabilizing cavity with a group of windows therein and the movable tuning element is a disc having a similarly spaced group of recesses below a surface of said disc supported for displacement to progressively restrict said windows with the plate surface or extend the windows with the recesses.

6. A magnetron as claimed in claim 5 and in which the stabilizing cavity has said windows closed by dielectric material and a metal plate formed with said recesses rotable adjacent said end wall windows.

* * * * *